United States Patent [19]

Kuhn

[11] 4,350,275

[45] Sep. 21, 1982

[54] METHOD AND APPARATUS FOR CONTROLLING THE SPEED OF A TRAVELING WEB

[75] Inventor: William T. Kuhn, 4 Heather Ct., Upper Saddle River, N.J. 07458

[73] Assignees: William T. Kuhn, Upper Saddle River; Paul F. Rose, Kinnelon; Thomas H. Rose, Chatham, all of N.J. ; a part interest

[21] Appl. No.: 196,772

[22] Filed: Oct. 14, 1980

[51] Int. Cl.[3] ..... B65H 25/12; B65H 23/22; B65H 25/02

[52] U.S. Cl. ..... 226/14; 226/42; 226/45; 226/104; 361/212

[58] Field of Search ..... 226/14, 10, 42, 44, 226/45, 104; 292/75.52, 75.51, 45; 361/212; 318/7; 250/327.1, 341, 344, 345, 346, 349, 521

[56] References Cited

U.S. PATENT DOCUMENTS

| | | | |
|---|---|---|---|
| 2,147,467 | 2/1939 | Stephenson | 226/42 |
| 2,375,304 | 5/1945 | Kilduff | 361/212 |
| 2,449,972 | 9/1948 | Beach | 361/212 |
| 2,907,565 | 10/1959 | Sauter | 226/42 |
| 3,105,625 | 10/1963 | Miserocchi | 226/42 |
| 3,240,411 | 3/1966 | Zarleng | 226/45 X |
| 3,384,281 | 5/1968 | Mason | 226/45 X |
| 4,195,791 | 4/1980 | Frazee | 242/45 |

*Primary Examiner*—Edward J. McCarthy
*Attorney, Agent, or Firm*—Lerner, David, Littenberg & Samuel

[57] ABSTRACT

A method and apparatus for controlling the speed of a traveling web being driven along a path by means of first and second drive rollers located at spaced positions along the path. An emitter device is provided for directing a radiation signal at the traveling web at a predetermined location along the path between the first and second drive rollers so as to be reflected thereby, and a detector device is provided for detecting the reflected radiation signal and for generating a position indication signal indicative of the position of the detector relative to the traveling web at the predetermined location. In response to the position indication signal, the detector device is caused to move so as to maintain a predetermined position with respect to the traveling web at the predetermined location. This movement of the detector in turn causes an appropriate control device to control the speed of the first drive roller relative to the speed of the second drive roller so as to maintain a predetermined relationship between the speeds of the first and second drive rollers. By utilizing this type of arrangement in which a radiation signal is reflected by the traveling web itself, it is possible to position the emitter and/or detector within the field or range of movement of the path along which the web travels.

32 Claims, 5 Drawing Figures

METHOD AND APPARATUS FOR CONTROLLING THE SPEED OF A TRAVELING WEB

BACKGROUND OF THE INVENTION

The present invention relates to an apparatus and method for controlling the positioning of a first element or device with respect to a second element or device whose position is variable, and more particularly to such a positioning apparatus used for controlling the speed of a traveling web being driven along a path by means of first and second drive means located at spaced positions along the path.

It is often desirable, in the manufacture, treating or other processing of a web or strand of material to utilize a plurality of drive devices for moving or driving the web along a path between various treatment or processing stations. With such arrangements in which a web is driven at two points along its length by different drive apparatus, as can be appreciated it is highly desirable that both drive apparatus be operated at the same speed, as otherwise more web material will be driven past the upstream drive mechanism that is taken up by the downstream drive mechanism, resulting in possible spilling or tangling of the web, or the amount of web material delivered by the upstream drive mechanism to the downstream drive mechanism will be insufficient such that the web will be stretched and possibly damaged. While various prior art systems have employed the technique of slaving one drive mechanism to the other drive mechanism, either by electrical or mechanical means, these systems have not proved completely satisfactory, and the search has continued for a better, more reliable speed control apparatus.

In some systems, because of the nature of the web material being driven along the path, a catenary or loop is provided between the two drive mechanisms so that the web, in essence sags therebetween. The upstream drive mechanism delivers the web into the loop and the outlet or downstream drive mechanism takes up the web material as it exits from the loop or sag portion. This type of arrangement is useful, especially with fragile web materials which can not be subjected to tension since not only is a margin of time provided for correcting or equalizing the speeds of the two drive mechanisms, but additionally, it is possible to utilize the loop as a means for detecting variations in and controlling the speeds of the drive apparatus. More particularly, if the exiting drive mechanism is traveling at a greater speed than the input or inlet drive mechanism, then the amount of sag between the two drive mechanisms will slowly decrease. By detecting this decrease in sag height, it is then possible to correct the speed of the input drive mechanism. Similarly, if the input drive mechanism is traveling at a greater speed than the output drive mechanism, then the height of the sag or catenary will increase slowly. By detecting this increase in height, the speed of the output drive mechanism may be increased to that of the input drive mechanism, or alternatively, the speed of the input drive mechanism slowed to match the speed of the output drive mechanism. Thus, the position of the path of travel of the web is used to determine and control the speeds of the input and output drive mechanisms.

Various types of detection systems have been provided in the prior art for these types of systems, some of which operate on a contact principle, i.e., those in which the web is trained about an idler roller at the low point of the loop and the position of the idler roller detected (see for example U.S. Pat. No. 2,108,410). However, it should be realized that with many types of web materials, in particular webs of knitted material, it is not possible to use such an arrangement since the contact by the movable idler roller could result in stretching, distortion, or other damage to the web.

Other prior art arrangements or systems for monitoring the controlling the sag depth of a catenary traveling web positioned over a pair of spaced drive mechanisms are of the non-contact type. For instance, in U.S. Pat. No. 2,379,132, there is disclosed a photoelectric system for producing a control voltage responsive to movement of looped material extending between two work devices. The system includes a light source and optics for projecting a plurality of horizontally disposed beams of light at photoelectric devices, the beams being positioned so as to be intercepted by the lowest point of the loop as the sag depth of the loop changes. A control voltage which varies inversely with the depth of the sag of the loop is generated to control the speed of the take-up device to alter the sag depth of the loop.

However, it should also be noted in this regard that with such photoelectric device systems, the light source and photoelectric devices are spaced on opposite sides of the path of travel of the web so that the beam of light is directed across the path of travel. Thus, such systems rely on the web to provide a contrast in order to block the light as the web moves therepast. As can be appreciated, problems may be encountered with such contrast detection systems with respect to web materials which are transparent or highly porous since the light beams would in essence pass through the web material and not provide an indication of blockage by the web. Still further, such systems require a very precise alignment of the light sources and the detectors. Additionally, it will further be appreciated that with such an arrangement, the sensors, i.e., the photoelectric devices and light sources, are externally fixed with respect to the traveling web and thus can only provide for stepwise changes or alterations in the speed of the various drive mechanisms.

One system which does provide a type of speed control utilizing movable sensors is shown in U.S. Pat. No. 2,108,410 entitled "Speed Control Mechanism" to W. R. Perry. In one of the embodiments of this system, a pair of light sources and corresponding photodetectors are mounted inside a box-like structure in vertically spaced relationship, the light sources being mounted on one side of the box and the detectors mounted on the opposite side of the box. A strand being wound up travels about a grooved roller at the low point of the sag, which roller is adapted to move vertically along a path between the respective pairs of light sources and photodetectors. The box is also mounted for movement and controlled so that the grooved roller is confined at an elevation between the upper light source and its photodetector in the box and the lower light source and its photodetector box. Thus, if the strand is wound up at a speed greater than that at which it is fed, the grooved roller will rise, thereby causing an interruption in the circuit of the upper photodetector. This in turn causes an appropriate control mechanism to slow the speed of the take-up mechanism and at the same time to raise the box-like structure to clear the obstruction of the upper photodetector. Similarly, if the strand is fed at a speed greater than that at which it is being taken up, the groove roller will move downwardly, thereby intercepting the light beam of the lower light source. This in turn causes the take-up mechanism to increase the speed, and additionally results in the box being lowered to again position the two light beams above and below the grooved roller.

While such a mechanism does provide for movable sensing devices, it will be appreciated that the structure thereof is quite crude, and additionally, the arrangement still operates with detectors arranged on opposite sides of the strand. While such an arrangement may be useful in connection with strands of material which have a very small web width, it will be appreciated that this type of arrangement would encounter problems with very wide webs which simply hang freely between the input and output drive mechanisms. For instance, with a completely free hanging loop, the web may swing or move slightly as a result of surrounding air currents. Additionally, such a system necessarily depends upon a contrast being presented by the web as it passes through the beam of light, i.e., such an arrangement may not be satisfactory for a web of a construction so as to be transparent to the light radiation.

In U.S. Pat. No. 4,195,791, there is disclosed a catenary controller for controlling the sag depth of optical fiber strands which is being continuously moved between a feed and take-up apparatus. In this patent, the apparatus includes a light source for illuminating the strand in the vicinity of the lowest point of the catenary loop, and a stationarily fixed TV camera for raster scanning the catenary vertically to provide an output signal which is then utilized for controlling the speed of the take-up apparatus to maintain a predetermined sag depth. The TV camera is fixedly positioned so as to be laterally spaced from the strand and optically aligned with the lower portion of the catenary, whereas the light source is arranged to be substantially normal to both the tangent of the catenary and the optical axis of the camera.

However, as noted above, with many types of traveling web apparatus, it is desirable to operate the apparatus to provide loops capable of varying heights in order to accommodate rapid processing changes in speed of the web. The apparatus disclosed in this U.S. Pat. No. 4,195,791 is not adapted for use with varying sag heights. Additionally, the use of an illuminating source and TV camera is limited to only specific types of web materials which can be illuminated.

Consequently, there exists a need for an improved positioning apparatus and method which is particularly useful in controlling the speed of a web traveling along a path and driven by separate drive means.

SUMMARY OF THE INVENTION

In accordance with the present invention, there is provided such an apparatus and method for controlling the speed of a traveling web driven along a path by means of first and second drive means located at spaced positions along the path. The apparatus includes emitter means for directing a radiation signal at the traveling web at a predetermined location along the path between the first and second drive means, and detector means for detecting a reflected radiation signal reflected by the traveling web moving along the path and for generating a position indication signal which is indicative of the position of the detector means relative to the traveling web at the predetermined location along the path. Moving means are provided which are responsive to the position indication signal for moving the detector means so as to maintain a predetermined position of the detector means with respect to the traveling web at the predetermined location. Control means are also provided responsive to the moving means for controlling the speed of the first drive means relative to the speed of the second drive means so as to maintain a predetermined relationship between the speeds of the first and second drive means.

In this manner, by utilizing reflection principles, problems of transparency of the web material and alignment problems of the prior art are minimized or avoided completely. Additionally, by providing a radiation signal to be reflected by the web and detected by the detector means, it is possible to position the detector means in the field or range of movement of the path as the speeds of the first and second drive means vary. Further, as a result of the fact that the detector means can be placed in the field of path movement, it is in turn possible to mount additional apparatus with the detector means in the field of movement of the path so as to be maintained at predetermined positions relative to the traveling web. For instance, with a catenated web, a barrier for preventing contact between the depending positions of the web and/or preventing swaying or swinging of the web as a result of air currents in the plant could be mounted together with the detector means between the depending portions of the looped web and then moved together with the detector means by the moving means in response to the position indication signal. In this way, the barrier will be closely spaced from the web, but not in contact with the web, thus positioned to serve its intended purpose. Another possibility is to mount a static eliminator, designed to remain a fixed distance from the traveling web to eliminate static electricity therearound, with the detector means for movement therewith.

In the preferred embodiment, both the emitter and the detector means are mounted for movement within the field of movement of the path along which the traveling web moves. Additionally, a pair of emitter and detector means are provided spacedly positioned across the width of the web and operable to maintain the pair of detector means within a limited range of distance from the traveling web despite changes in the speed at which the second drive means is operated.

The method in accordance with the present invention involves directing a radiation signal at a traveling web at a predetermined location along the path of movement so as to be reflected by the web, the web being driven by first and second drive means at spaced positions along the path of movement of the web, and then detecting with detector means the reflected radiation signal and generating a position indicating signal indicative of the position of the detector means relative to the web at the predetermined location. The detector means is then moved so as to maintain a predetermined position of the detector means with respect to the traveling web. The movement of the detector means is then detected and the speed of the first drive means adjusted so as to maintain a predetermined relationship between the speeds of the first and second drive means.

Also, in accordance with the present invention, the emitter means, detector means and moving means, and the method of use of same, may be utilized for controlling the positioning of a first element or device with respect to a second element or device which is variable in position. For instance, the first device may comprise a static eliminator which, as noted above, is designed to efficiently operate at a predetermined distance from the traveling web, and the second element may comprise a roll from which a web of material is unwound. As the web of material is unwound, the amount of material on the roll changes such that the position of the surface of the roll relative to the center gradually decreases. Thus, the apparatus comprising the emitter means, detector means and moving means can be utilized to maintain the position of the static eliminator at a predetermined position relative to the surface of the roll from which the web material is being unwound. As will be appreciated, there are a number of other uses for the emitter means, detector means and moving means in accordance with the present invention.

These and further features and characteristics of the present invention will be apparent from the following detailed description in which reference is made to the enclosed drawings which illustrate preferred embodiments of the present invention.

DETAILED DESCRIPTION OF THE PREFERRED EMBODIMENT

Figure 1:
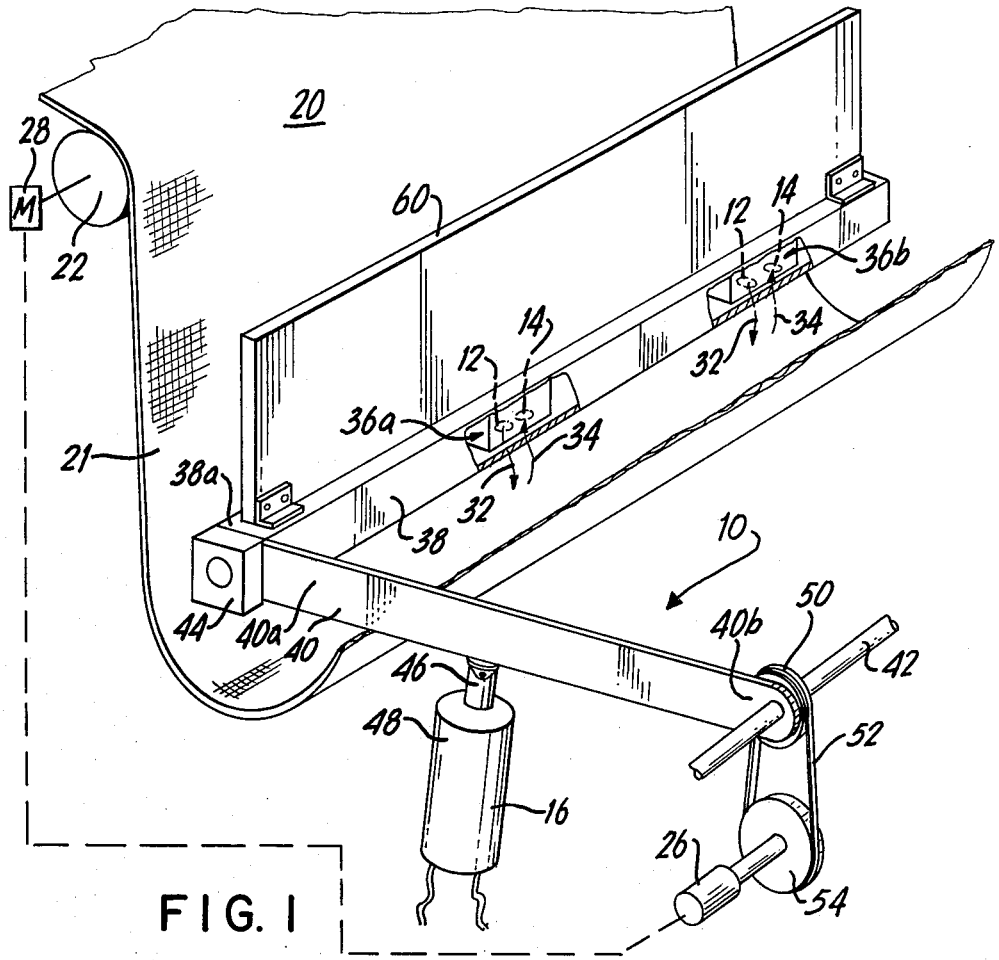
FIG. 1 is a perspective view of one embodiment of the apparatus in accordance with the present invention positioned with respect to a looped portion of a traveling web being driven by first and second drive means.

The basic apparatus 10 in accordance with the present invention is shown in FIG. 1 and includes emitter means 12 for generating and directing a radiation signal at an object to be reflected thereby, detector means 14 for detecting a reflected radiation signal reflected by the object and for generating a position indication signal indicative of the position of the detector means 14 relative to the object, and moving means 16 responsive to the position indication signal for moving the detector means 14 so as to maintain a predetermined position of the detector means 14 with respect to the object. This apparatus is particularly well-suited for use in controlling the speed of a traveling web 20 being driven along a path by means of first and second drive means 22, 24 located at spaced positions along the path by providing control means 26 responsive to the moving means 16 for controlling the speed of the first drive means 22 relative to the speed of the second drive means 24 so as to maintain a predetermined relationship between the first and second drive means 22, 24. Accordingly, the present invention will be described in greater particularity with reference to such a use. However, it should also be appreciated that the basic apparatus 10 can be used for a number of purposes other than simply controlling the speed of a traveling web. Some of these uses will be described in greater detail hereinbelow.

Also, although the present invention is most useful and will be described with reference to a web 20 of knitted material which does not have any substantial tensile strength, it should be appreciated that the apparatus and method of the present invention could also be utilized with respect to webs of different material, which material may not necessarily be subject to the same restrictions, limitations, etc. of use as materials lacking tensile strength. In fact, because of its noncontact type of control, the present invention may be highly useful with respect to such other web materials which do possess a certain degree of tensile strength, such as for example, paper webs, webs of plastic material, etc.

Figure 2:
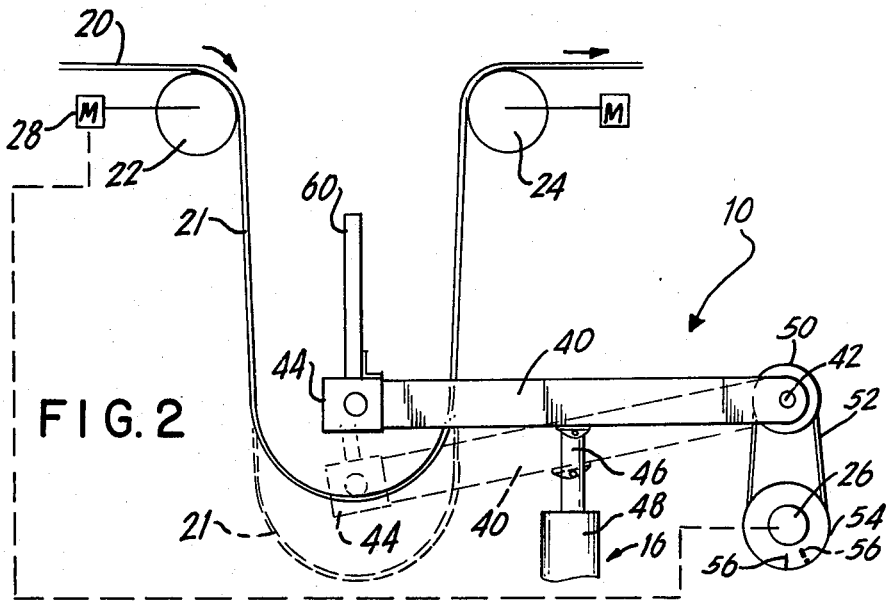
FIG. 2 is an end elevational view of the apparatus and web shown in FIG. 1 illustrating, in dotted outline, a changed position of the web and apparatus as a result of one drive means being operated at a speed greater than the other drive means.

Referring more particularly now to the drawings wherein like reference characters represent like elements, there is shown in FIGS. 1 and 2 a web 20 of material being driven by means of first and second drive rollers 22, 24 which are each appropriately controlled by respective motors 28, 30, the motors 28, 30 for the drive rollers 22, 24 being independently operable from one another. The web 20 for example may be a web of material lacking tensile strength, such as a knitted textile, which might otherwise deform if subjected to any tensioning during the feeding of the web 20 from the first drive roller 22 to the second drive roller 24. As is well known in the art, the web 20 is preferably catenated or looped between the two drive rollers 22, 24 to thus form a looped section 21 which extends downwardly from the elevation of the drive rollers 22, 24. Accordingly, the web is fed from the first drive roller 22 downwardly to the lower elevation of the looped section 21 and then upwardly over the second drive roller 24. The web 20 may have a width of any desired dimension, such as for example, from a couple of inches in width up to ten feet in width, or even greater depending on the type of material, its application or use, etc. As the web 20 lacks tensile strength, any contact which might serve to place a tension on the web 20 might damage or deform the web 20, and consequently, it is necessary that no external devices or apparatus, other than the drive rollers 22, 24 about which the web 20 passes, be permitted to physically contact or engage the web 20 during its travel between the drive rollers 22, 24.

It will be appreciated that during the feeding and take-up of the web 20 by means of the first and second drive rollers 22, 24, if the first or input drive roller 22 operates at a greater speed of rotation than the second or output drive roller 24, the loop 21 of web material 20 will increase in height, i.e., the lower catenated portion 21 of the web 20 will move vertically downward relative to the elevation of the rollers 22, 24, such as for example shown in FIG. 2 in dotted outline. On the other hand, if the speed of rotation of the output drive roller 24 is greater than the speed of the input drive roller 22, the catenated portion 21 will decrease in height, i.e., the looped portion 21 of the web 20 will move vertically upwardly. Accordingly, it is desired, as noted above, to maintain the speeds of the first and second drive rollers 22, 24 substantially equal to one another, and it is this function to which the apparatus 10 of the present invention is mainly directed.

In the following description, it will be assumed that the output drive roller 24 is operated at a speed which is dependent on other conditions in the overall apparatus through which the web 20 is traveling and which may vary during travel of the web 20. Thus, the apparatus 10 of the present invention is operative to control the speed of rotation of the input drive roller 22 so as to be equalized with the speed of the output drive roller 24. However, it will also be appreciated by persons skilled in the art that the input drive roller 22 could be the independently operated drive means and the output drive roller 24 controlled by the apparatus 10 of the present invention, or alternatively, that the relative speeds of both drive rollers 22, 24 could be controlled by the apparatus 10 of the present invention.

In the preferred embodiment, the speed control apparatus includes emitter means 12 and detector means 14 positioned with respect to the web, respectively, for directing an electromagnetic radiation signal 32 toward the traveling web 20 so as to be reflected thereby, and for detecting the reflected radiation signal 34 and then generating a position indication signal which is indicative of the position of the detector means 14 relative to the traveling web 20. In response to this position indication signal, the detector means 14 is moved relative to the traveling web 20 so as to maintain a predetermined position of the detector means 14 with respect to the traveling web 20. This movement of the detector means 14 is then sensed by suitable control means 26 which is operable to control the speed of the input drive roller 22 relative to the speed of the output drive roller 24 so as to maintain a predetermined relationship between the speeds of the input and output drive rollers 22, 24.

More particularly, in accordance with the preferred embodiment, the emitter means 12 and detector means 14 comprise a pair of sensors 36*a*, 36*b*, each of which includes an emitter portion or component and a collector portion or component. The emitter portion of each sensor 36 comprises the emitter means 12, and the collector portion comprises the detector means 14. The two sensors 36*a*, 36*b* are spacedly positioned within a common sensor housing member 38, as best seen in FIG. 1. One end 38*a* of the sensor housing member 38 is fixedly connected to one end 40*a* of a support arm 40, the other end 40*b* of the support arm being pivotably mounted on a stationary support shaft 42 spaced from the path along which the web 20 travels (see FIGS. 1 and 2). A counterweight 44 is provided at the one end 40*a* of the support arm 40 on the side opposite the sensor housing 38 so as to maintain the housing 38 in a generally horizontal plane. A positioning actuator means 16 is provided intermediate the ends 40*a*, 40*b* of the support arm 40 for moving the support arm 40 in response to a position indication signal from the sensors 36*a*, 36*b*. The positioning actuator means 16 may for example comprise a hydraulic piston 46 having one end attached to the support arm 40 and the other end received within a cylinder 48 which is stationarily supported, such as for example from the main support apparatus or frame for the apparatus along which the traveling web 20 moves.

The support shaft 42 on which the support arm 40 is pivotably movable is likewise fixedly supported from the frame or base, and carries a rotatable sprocket member 50 which is bolted to the end 40*b* of the support arm 40 so as to be movable therewith. In the embodiment shown in FIG. 1, a chain 52 connects this sprocket 50 to a input sprocket 54 for a speed control device 26 which is spacedly mounted relative to the support shaft 42. The speed control device 26 in this embodiment is a conventional type of speed control device which accepts rotational inputs for varying the speed of the motor 28 driving the input drive roller 22. For example, the speed control device 26 could be a hydraulic speed control device which controls the amount of flow of hydraulic fluid to a hydraulic motor driving the input drive roller 22 or a potentiometer for a DC driven drive system. Such speed control devices 26 are well known in the art and serve to vary the speed of rotation of the drive motor depending upon the rotational input provided thereto.

In the embodiment shown in FIGS. 1 and 2, this rotational input is provided by rotational movement of the end 40*b* of the support arm 40. More specifically, when the support arm 40 is pivoted about the support shaft 42, the chain sprocket 50 is rotated to thereby rotate the input sprocket 54 to the speed control device 26 by means of the chain 52. For instance, referring to FIG. 2, when the support arm 40 is pivoted downwardly from the substantially horizontal position shown in solid outline in FIG. 2 to the position shown in dotted outline, the fixed sprocket 50 bolted to the end 40*b* of the support arm 40 rotates in a counterclockwise direction to thereby rotate the input sprocket 54 in a counterclockwise direction. This for example can be seen by movement of the reference point 56 on the input sprocket 54 from the solid line position to the dotted line position. This rotational input is detected by the speed control device 26 which then generates an appropriate signal to change the speed of the motor 28 to in turn vary the speed that the input drive roller 22 rotates, in this instance to decrease the speed. The amount of pivoting movement of the support arm 40, and thus the rotational input to the input sprocket 54, governs in a well known manner the amount of change in speed.

The emitter component of each sensor 36 in the preferred embodiment generates electromagnetic waves 32 of a reference intensity and frequency, and the collector component is designed to generate a detection signal when it receives reflected electromagnetic waves 34 of the reference frequency and of a preselected threshold intensity. Thus, each sensor 36 is of a binary nature—i.e., it generates a detection signal whenever reflected radiation of the specified frequency is detected to be above a preselected threshold intensity; no signal is generated if reflected radiation 34 of the reference frequency is not above the preselected threshold intensity. Such sensors 36 for example may comprise retroreflective scanners having binary outputs, commercially available from Banner Engineering Corporation, together with appropriate control logic for converting the output signals from the scanners into the appropriate position indication signal for controlling the positioning actuator means 16.

The threshold intensity level for each of the sensors 36 is individually adjustable. As will be appreciated, since intensity of radiation decreases by the square of the distance from its source, the selected threshold intensity will correspond to or be representative of the sensor 36 (in particular the collector part thereof) being a specified distance from the traveling web 20 (i.e., the portion of the web 20 reflecting the signal 32). That is, the selected intensity level will govern or determine the distance that the sensor 36 must be from the web 20 in order for a detection signal from the sensor 36 to be generated—i.e., whenever the sensor 36 is located from the web at or less than the distance corresponding to the selected intensity level, a detection signal will be generated, whereas if the sensor 36 is located at a greater distance from the web 20, no detection signal will be generated.

The function of the pair of sensors 36*a*, 36*b* is to sense the position of a selected portion of the traveling web 20 along the path of movement of the traveling web 20, and to generate an appropriate position indication signal whenever the position of the sensor housing 38 relative to the web 20 at the preselected location along the path is outside a desired range of distance. This sensing and signal generating function of the pair of sensors 36*a*, 36*b* is achieved without physically contacting the web 20. Also, in the preferred embodiment, the reference point along the path used for this determination and sensing comprises the lowermost point of the looped portion of the web 20.

Figure 5:
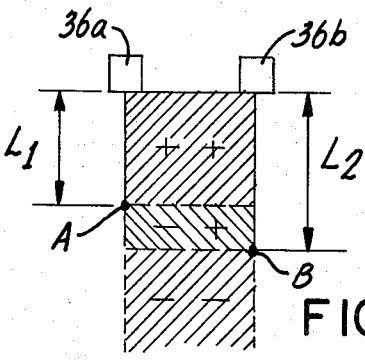
FIG. 5 is a schematic diagram illustrating the operation of the pair of emitter and collector means in accordance with the present invention.

More particularly, with reference to FIG. 5, by setting both sensors 36*a*, 36*b* to have different limits on the threshold intensity, and thus different limits on the corresponding distance from the web 20 at which the sensors will generate the detection signals, it is possible to control the position of the sensors 36*a*, 36*b* to be within a specified range from the web 20. Specifically, one sensor 36*a* is set at a first intensity level, for example level A so that if the distance from the sensor 36*a* to the web 20 is less than the distance $L_1$, a detection signal will be generated. If the distance from the first sensor is greater than $L_1$, no detection signal will be generated by the sensor 36*a*. This is indicated schematically in FIG. 5 wherein "+" indicates when a detection signal will be generated and wherein "−" indicates when no detection signal will be generated. Similarly, by setting the reference intensity for the other sensor 36*b* at level B, a detection signal will be generated by that sensor 36*b* so long as the distance from the sensor 36*b* to the web 20 is less than or equal to the distance $L_2$. If the distance from the sensor 36*b* is greater than $L_2$, no detection signal will be generated.

With an appropriate sensing mechanism (not shown) for detecting the presence or absence of detection signals generated from the sensors 36*a*, 36*b* and in particular for sensing whether 0, 1 or 2 such detection signals are generated, it is possible to determine whether the pair of sensors 36*a*, 36*b* (since both sensors 36*a*, 36*b* are at the same elevation in the sensor housing 38) are: (1) at a distance less than $L_1$ (i.e., when both sensors 36*a*, 36*b* generate signals); (2) within the range between $L_1$ and $L_2$ (when only one detection signal is generated); or (3) at a distance greater than $L_2$ (when no detection signal is generated). Depending on whether 0, 1 or 2 detection signals are sensed, an appropriate position indication signal is generated to actuate the actuator 16 to cause the arm 40 to move the sensor housing 38 accordingly. That is, if the distance between the sensors 36*a*, 36*b* and the web 20 is less than $L_1$, the hydraulic piston 46 will be operated to raise the arm 40 until only one detection signal is detected, which corresponds to the sensors 36*a*, 36*b* being located a distance between $L_1$ and $L_2$ from the web 20. Similarly, if no detection signals are generated, then the piston 46 will be actuated to lower the arm 40 until one detection signal is detected, thereby indicating that the sensors 36*a*, 36*b* have been moved from a distance greater than $L_2$ from the web to a distance ranging between $L_1$ and $L_2$.

Whenever the sensors 36*a*, 36*b* are located within the range between $L_1$ and $L_2$ from the web 20, there will be no movement of the support arm 40 and thus the speed of input drive roller 22 will remain the same. Only when the distance becomes either greater than $L_2$ or less than $L_1$ will the piston 46 be actuated to move the support arm 40 to thereby move the sensors 36*a*, 36*b*. As explained hereinabove, movement of the support arm 40 will cause an appropriate change in the rotational input to the speed control device 26 to thereby change the speed of rotation of the input drive roller 22 accordingly.

It will be noted and appreciated that not only can the upper and lower limits of the desired distance in which the sensors 36*a*, 36*b* are maintained from the web 20 be controlled by suitable control of the preselected threshold intensities of the sensors 36*a*, 36*b*, but also the distance of the sensors 36*a*, 36*b*, and thus the sensor housing 38, from the web 20 can be controlled by a similar suitable adjustment. In other words, by appropriately adjusting the threshold intensities of each of the collector components, not only can the distance from the collector component to the web 20 be controlled but also the differences between the two limits. Additionally, by appropriately controlling these threshold intensities, it is possible to achieve virtually continuous correction of the speed of the input drive roller 22 relative to the output drive roller 24, or at the very least to achieve very small stepwise correction.

The provision of being able to mount the sensors 36*a*, 36*b* within the field or range of movement of the path along which the web 20 travels, (i.e., the path moves from a vertically lower position to a vertically upper position, depending on the speeds at which the drive rollers 22, 24 rotate and the response time for correction or equalization of the speeds) is most advantageous since it permits mounting of other devices or apparatus on the sensor housing 38 to be within the path of movement. For instance, as seen in FIG. 1, a barrier member 60 is mounted to the upper surface of the sensor housing 38. This barrier member 60 serves to maintain one side of the traveling web 20 from touching the other side of the web 20. This is advantageous because it eliminates a source of disequilibrium of the traveling web (i.e., the web may otherwise become tangled, damaged, etc., and erroneous signals generated for speed control). In this regard, it is to be noted that since the sensors 36*a*, 36*b* are moved in response to variations in the loop height, it is possible to mount the barrier member 60 for similar movement by simply mounting the barrier member 60 and sensors 36*a*, 36*b* together. Thus, the barrier member 60 will also remain out of contact with the web 20.

Figure 3:
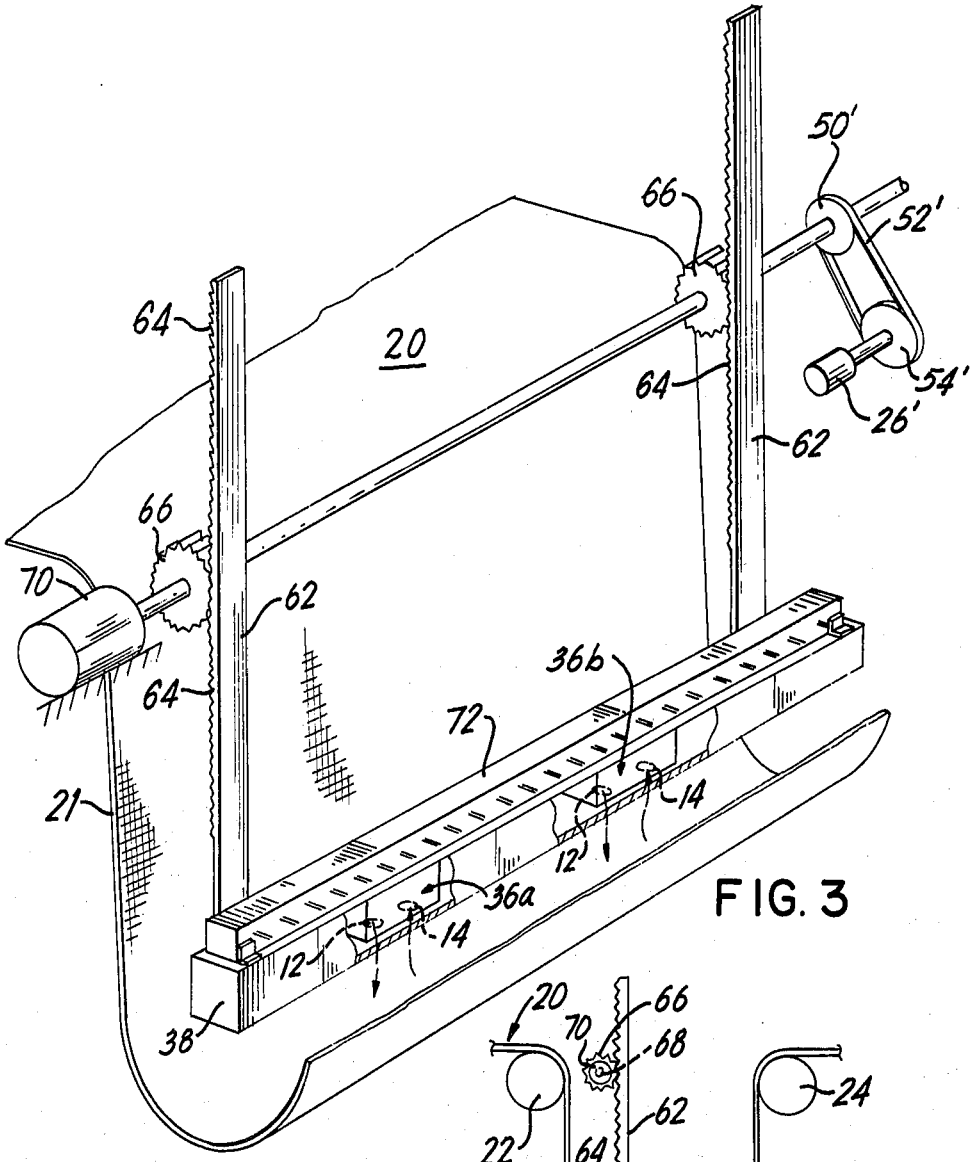
FIG. 3 is a perspective view of another embodiment of the apparatus in accordance with the present invention positioned with respect to a looped portion of a traveling web.
Figure 4:
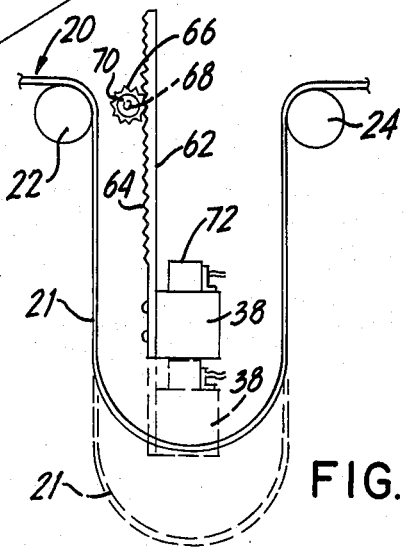
FIG. 4 is an end elevational view of the apparatus shown in FIG. 3 illustrating, in dotted outline, a changed position of the web and apparatus.

Another embodiment of the apparatus in accordance with the present invention is shown in FIGS. 3 and 4. In this embodiment, again the web 20 of material is being driven by a pair of drive rollers 22 (only one of which is shown) so as to provide a loop or catenated portion 21 therebetween. The speed control apparatus 10, as with the embodiment shown in FIGS. 1 and 2, includes a sensor housing 38 having first and second sensors 36*a*, 36*b* therein, each of which includes emitter means 12 and detector means 14. In the embodiment shown in FIG. 3, however, the sensor housing 38 is mounted to a pair of vertically extending spaced rack members 62 having a plurality of teeth 64 on one side. The teeth 64 are adapted to be engaged by a suitable gears 66 which, when rotated, either raise or lower the sensor housing 38. The gears are fixedly mounted on a suitable support shaft 68 which in turn is operatively connected to a rotary actuator or motor 70 for rotating the shaft 68 and gears 66 either clockwise (as viewed in FIG. 3) to lower the sensor housing 38, or counterclockwise to raise the sensor housing 38. The opposite end of the actuating shaft 68 has a sprocket 50' mounted thereto with a chain 52' entrained thereabout for driving an input sprocket 54' to a suitable speed control device 26', similar to the arrangement shown in FIG. 1.

As with the embodiment shown in FIGS. 1 and 2, the sensors 36*a*, 36*b* are each operative to generate a detection signal if it receives a radiation signal reflected by the web 20 of a preselected threshold intensity, i.e., when the sensor 36*a* or 36*b* is positioned within a specific distance from the web 20, corresponding to the preselected threshold intensity of the sensor 36*a* or 36*b*. By setting the intensity level for each of the sensors 36*a*, 36*b* to different values, the position of the sensor housing 38 and thus the sensors 36*a*, 36*b*, relative to the web 20 may be maintained at virtually any desired distance by using the same type of logic utilized with respect to the sensors 36*a*, 36*b* of the embodiment shown in FIGS. 1 and 2. Specifically, the rotary actuator 70 is operative to rotate the gears 66 in a clockwise direction, as viewed in FIG. 3, when no detection signal from either of the sensors 36*a*, 36*b* is generated, thereby indicating that the distance between the sensors 36*a*, 36*b* and the web 20 is greater than a desired distance, and to rotate the gears 66 in the counterclockwise direction, as viewed in FIG. 3, when a signal from each of the sensors 36*a*, 36*b* is generated, thereby indicating that the distance from the web 20 to the sensors 36*a*, 36*b* is less than the desired distance. So long as the sensor housing 38 and sensors 36*a*, 36*b* are maintained within a specified distance or range from the web 20, the rotary actuator 70 will remain inoperative, and thus the speed control device 26 simply maintains the same speed for the input drive roller 22.

In the embodiment of FIGS. 3 and 4, a static eliminator 72 has been mounted on the sensor housing 38 for drawing static electricity from the web 20 and the surrounding area to provide a substantially static free web. As is well known in the art, such static eliminators 72, to be effective in achieving this purpose, must be maintained at a relatively close spacing, on the order of one to two inches, from the web 20. This spacing and maintenance of this spacing can be easily achieved with the present invention by simply mounting the static eliminator 72 to the sensor housing 38 whose position or distance from the web 20 is maintained within desired limits.

It will be appreciated that although the apparatus 10 of the present invention has been shown and described for use with reference to a catenated or free hanging loop 21 of a traveling web 20, the apparatus 10 can also be used with respect to other traveling web arrangements which do not necessarily have a looped section but in which it is still desired to provide for maintenance of a desired position or orientation of the traveling web 20 by means of a non-contact system. For instance, the apparatus could be used to simply maintain the relative speeds of first and second drive means in predetermined relationship to achieve a desired result, such as for example a desired angle or bending of a web.

Still further, although the apparatus 10 comprising the sensors 36*a*, 36*b* and moving means 16 for moving the sensors 36*a*, 36*b* has been shown for use in connection with control means 26 for controlling the speed of one of the drive means 22, 24 for the traveling web 20, the apparatus 10 in accordance with the present invention could also be used for purposes other than controlling the speeds. For instance, the basic apparatus 10 can also be used for simply maintaining an element at a predetermined desired distance from another element whose position is variable. As will be noted with reference to FIG. 3, the basic apparatus 10 is used for maintaining the position of the static eliminator 72 with respect to the web 20 at a certain desired distance from the web 20, i.e., at a distance substantially corresponding to the distance that the sensors 36*a*, 36*b* are maintained from the web 20.

Another example of the use of the present invention for purposes other than speed control would be with respect to a web of material being unwound from a roll. As can be appreciated, the distance of the surface of the web from the center of the roll decreases as the web of material is unwound. If it is desired to position a device, such as for example a static eliminator 72, with respect to the surface of the roll as the web is being unwound, the apparatus 10 of the present invention could be used to maintain the desired spacing. In this instance, it would only be necessary to use a single sensor 36 which would cause operation of the moving means 16 or 70, 66 to move the sensor 36, and thus the static eliminator 72, closer to the roll as the web is being unwound when the sensor 36 senses that the distance of the sensor 36 from the roll is greater than the desired limit. Movement of the sensor 36 toward the roll would also move the static eliminator 72 toward the roll and thereby maintain the desired positioning of the static eliminator 72 with respect to the web material being unwound from the roll.

On the other hand, a pair of sensors 36*a*, 36*b* may be desired if it is necessary for the moving means to not only move the sensors 36*a*, 36*b* (and thus the device) closer to the roll, but also to move the sensors 36*a*, 36*b* away from the roll if the distance from the surface of the roll to the center of the roll should increase, such as when the web is wound onto the roll. That is, only one binary type sensor would be necessary if the adjustment in position is to be unidirectional, whereas a pair of such sensors would be required if adjustment in movement is to be bidirectional.

Still further, although the present invention has been described hereinabove with reference to binary type sensors 36*a*, 36*b* which together define the limits between which the sensors 36*a*, 36*b* are to be maintained from the web 20, it of course should be realized that a single different type of sensor could be utilized which determines the precise distance from the sensor to the web. For example, the pair of binary type sensors 36*a*, 36*b* could be replaced with a single sensor having an output proportional to the distance from the web. This type of scanner, together with appropriate control logic, would determine the intensity level of the reflected radiation signal, compare such intensity level with a reference intensity level which corresponds to a reference distance from the web 20, and on the basis of this comparison, provide a precise determination of the distance of the sensor from the web 20 to be used in controlling the moving means 16. Such an arrangement would simplify the apparatus 10 and also increase the accuracy of the determination of the distance from the web 20, as well as the accuracy of the control of the speed of the first drive means. It will be appreciated that such a scanner having proportional output is in essence equivalent to setting the threshold intensity levels on two binary output sensors 36*a*, 36*b* to be the same.

Furthermore, it will also be appreciated that although in the preferred embodiment, the control means 26 is operative to maintain equalization of the speeds of the first and second drive means 22, 24, the control means could also be operative to maintain a different relationship between the speeds of the first and second drive means, such as for example a 5% increase in the speed of one drive means relative to the other drive means which, in certain instances, may be desired for different purposes.

Accordingly, it will be appreciated that in accordance with the present invention, there is provided an apparatus 10 for controlling the positioning of a first element or device 60, 72, with respect to a second element or device 20 whose position is variable. The apparatus 10 includes emitter means 12 for directing a radiation signal 32 at the second element (i.e., the web 20) so as to be reflected thereby, and detector means 14 for detecting a reflected signal 34 reflected by the second element 20 and for generating a position indication signal indicative of the position of the detector means 14 relative to the second element 20. Means 38 are also provided for mounting the first device 60, 72 and the detector means 14 in fixed relationship to one another, and moving means 16, 70, 66 are provided responsive to the position indication signal for moving the detector means 14 and thus the first device 60, 72 so as to maintain a predetermined position of the detector means 14 and the first device 60, 72 with respect to the second element 20.

When the present invention is used for controlling the speed of a traveling web 20 being driven along a path by means of first and second drive means 22, 24, control means 26 are provided responsive to the moving means 16, 70, 66 for controlling the speed of one of the drive means 22 relative to the speed of the other drive means 24 so as to maintain a predetermined relationship between the speed of the first and second drive means 22, 24.

While the preferred embodiments of the present invention have been shown and described, it will be understood that such are merely illustrative and that changes may be made without departing from the scope of the invention as claimed.

What is claimed is:

1. Apparatus for controlling the speed of a traveling web being driven along a path by means of first and second drive means located at spaced positions along said path, said apparatus comprising:

emitter means for directing a radiation signal at said traveling web at a predetermined location along said path between said first and second drive means;

detector means for detecting a reflected radiation signal reflected by said traveling web moving along said path, and for generating a position indication signal indicative of the position of said detector means relative to said traveling web at said predetermined location along said path;

moving means responsive to said position indication signal for moving said detector means so as to maintain a predetermined position of said detector means with respect to said traveling web at said predetermined location; and control means responsive to said moving means for controlling said first drive means relative to said second drive means so as to maintain a predetermined relationship between the speed at which said first drive means drives said web along said path and the speed at which said second drive means drives said web along said path.

2. The apparatus of claim 1 further including a support member for mounting of said emitter means and said detector means thereon, said support member being movably mounted with respect to said path of movement of said traveling web; and wherein said moving means is operative to move said support member in response to said position indication signal.

3. The apparatus of claim 2 wherein said path of movement of said traveling web at said predetermined location is movable between first and second positions in response to changes in speed of said first and second drive means, and wherein said support member is mounted for movement within the field of movement of said path between said first and second positions.

4. The apparatus of claim 3 wherein said path of movement of said web comprises a catenated portion having depending sections and a bottom section, said catenated portion being between said first and second drive means, and wherein said support member is mounted for movement at a position between said depending sections of said catenated portion of said web and at an elevation above said bottom section of said catenated portion.

5. The apparatus of claim 4 further including a barrier member for maintaining said depending sections separated from one another, said barrier member being mounted on said support member for movement therewith.

6. The apparatus of claim 4 further including static eliminator means for eliminating static electricity from said web as said web moves therepast, said static eliminator being mounted on said support member for movement therewith.

7. The apparatus of claim 2 wherein said moving means comprises a support arm mounted for pivotal movement about a pivot point and attached to said support member at a point spaced from said pivot point, and pivoting means for pivoting said support arm about said pivot point in response to said position indication signal.

8. The apparatus of claim 7 wherein said control means is responsive to changes in the angular position of said support arm relative to said pivot point for controlling the speed of said first drive means relative to the speed of said second drive means.

9. The apparatus of claim 8 wherein said control means includes a first sprocket member mounted for pivotal movement with said support arm about said pivot point, a second sprocket member spaced from said first sprocket member, a chain entrained about said first and second sprocket members, and a rotational speed control device connected to said second sprocket member for varying the speed of said first drive means in response to rotational movement of said second sprocket member.

10. The apparatus of claim 2 further including at least one rack member extending from said support member, and wherein said moving means comprises at least one gear member engagable with said rack member and rotary actutator means for rotating said gear member about an axis to move said rack member in response to said position indication signal.

11. The apparatus of claim 10 wherein said control means is responsive to changes in the rotational position of said at least one gear member about said axis for controlling the speed of said first drive means relative to the speed of said second drive means.

12. The apparatus of claim 11 wherein said control means includes a first sprocket member mounted for rotation with said at least one gear member about said axis, a second sprocket member spaced from said first sprocket member, a chain entrained about said first and second sprocket members, and a rotational speed control device connected to said second sprocket member for varying the speed of said first drive means in response to rotational movement of said second sprocket member.

13. The apparatus of claim 2 wherein said emitter means comprises a pair of emitter components spacedly positioned on said support member, and wherein said detector means comprises a pair of detector components spacedly positioned on said support member.

14. The apparatus of claim 13 wherein each of said detector components is operative to generate a detection signal when said detector component detects a reflected radiation signal above a preselected threshold intensity.

15. The apparatus of claim 14 wherein one of said detector components has a first preselected threshold intensity level, and the other of said detector components has a second preselected threshold intensity level different from said first preselected intensity level, and wherein said moving means is operative to move said support member in response to the number of detection signals generated by said pair of detection components so as to maintain said predetermined positioning of said detector components relative to said traveling web.

16. The apparatus of claim 15 wherein said first preselected threshold intensity level corresponds to the intensity of said reflected radiation signal for said one detector component when said one detector component is a first predetermined distance from said web, and wherein said second predetermined threshold intensity level corresponds to the intensity of said reflected radiation signal for said other detector component when said other detector component is a second predetermined distance from said web, and wherein said moving means is operative to move said support member toward said web when the number of detection signals generated by said pair of detector components is zero and to move said support member away from said web when the number of detection signals generated by said pair of detector components is two whereby said pair of detector components are maintained between said first distance and second distance from said web.

17. The apparatus of claim 1 wherein said control means is operative to control said first drive means to drive said traveling web at a speed substantially equal to the speed at which said traveling web is driven by said second drive means.

18. The apparatus of claim 1 wherein said detector means is operative to detect the intensity level of said reflected radiation signal and compare said detected intensity level to a reference intensity level corresponding to a predetermined distance from said web.

19. A method for controlling the speed of a traveling web being driven along a path by means of first and second drive means located at spaced positions along said path, said method comprising the steps of:

directing a radiation signal at said traveling web at a predetermined location along said path between said first and second drive means so as to be reflected by said traveling web;

detecting with detector means the reflected radiation signal reflected by said traveling web moving along said path, and generating a position indication signal indicative of the position of said detector means relative to said traveling web at said predetermined location along said path;

moving said detector means in response to said position indication signal so as to maintain a predetermined position of said detector means with respect to said traveling web at said predetermined location; and detecting movement of said detector means and controlling in response thereto said first drive means relative to said second drive means so as to maintain a predetermined relationship between the speed at which said first drive means drives said web along said path and the speed at which said second drive means drives said web along said path.

20. The method of claim 19 in which said path of movement of said traveling web at said predetermined location is movable between first and second positions in response to changes in speed of said first and second drive means, and wherein said detector means is mounted for movement within the field of movement of said path between said first and second positions.

21. The method of claim 19 in which said traveling web includes a catenated portion having depending sections and a bottom section, said catenated portion being between said first and second drive means, and wherein said detector means is positioned between said depending sections of said catenated portion and at an elevation above said section of said catenated portion.

22. The method of claim 21 in which said detector means comprises a pair of detector devices spacedly positioned along support means, and wherein said step of moving comprises moving said support member relative to said traveling web.

23. The method of claim 22 in which a pivotable support arm pivotable about a pivot point is attached to said support member at a position spaced from the pivot point, wherein said step of moving comprises pivoting said support arm about said pivot point, and said step of detecting movement of said detector means comprises detecting rotational movement of said support arm about said pivot point.

24. The method of claim 22 in which a rack member extends from said support member, and wherein said step of moving comprises rotating a shaft having at least one gear thereon which is engagable with said rack member, and said step of detecting comprises detecting rotational movement of said shaft.

25. The method of claim 19 wherein the step of generating a position indication signal comprises generating two detection signals when the position of said detector means is less than a first predetermined distance from said traveling web, generating one detection signal when the distance of said detector means from said web is between a first predetermined distance and a second predetermined distance, and generating zero detection signals when the position of said detector means is at a distance greater than said second predetermined distance from said web, and wherein said step of moving comprises sensing the number of detection signals generated and moving said detector means in a direction toward said web when zero detection signals are generated and moving said detector means in a direction away from said web when two detection signals are sensed.

26. The method of claim 25 wherein said detector means comprises first and second detector components each of which is operable to generate a detection signal when it detects a radiation signal above a threshold intensity level, said first detection component having a first preselected threshold intensity level corresponding to the intensity of said reflected radiation signal for said first detector component when said first detector component is said first predetermined distance from said web, and said second detector component having a second preselected threshold intensity level corresponds to the intensity of said reflected radiation signal for said second detector component when said second detector component is said second predetermined distance from said web.

27. Positioning apparatus for controlling the position of a first element with respect to a second element whose position is variable, said apparatus comprising:

emitter means for directing a radiation signal at said second element;

detector means for detecting a reflected radiation signal reflected by said second element and for generating a position indication signal indicative of the position of said detector means relative to said second element;

mounting means for mounting said first element in fixed relationship to said detector means; and moving means responsive to said position indication signal for moving said detector means and said first second element so as to maintain a predetermined position of said detector means with respect to said second element whereby the position of said first element with respect to said element is also maintained as the position of said second element varies.

28. The apparatus of claim 27 wherein said mounting means comprises a support member for mounting said emitter means, said detector means and said first element thereon; and wherein said moving means is operable to move said support member in response to said position indication signal.

29. The apparatus of claim 28 wherein said first element comprises a static eliminator mounted on said support member and said second element comprises the position of a traveling web being driven along a path at a predetermined location along said path.

30. The apparatus of claim 28 wherein said moving means comprises a support arm mounted for pivotal movement about a pivot point and attached to said support member at a point spaced from said pivot point, and pivoting means for pivoting said support arm about said pivot point in response to said position indication signal.

31. The apparatus of claim 28 further including at least one rack member extending from said support member, and wherein said moving means comprises at least one gear member engagable with said rack member and rotary actuator means for rotating said gear member about an axis to move said rack member in response to said position indication signal.

32. A method for controlling the position of a first element with respect to a second element whose position is variable, said method comprising the steps of:

directing a radiation signal at said second element so as to be reflected by said second element;

detecting with detector means the reflected radiation signal reflected by said second element and generating a positioning signal indicative of the position of said detector means relative to said second element;

mounting said first element with respect to said detector means so as to remain in fixed position with respect thereto; and moving said detector means and said first element in response to said position indication signal so as to maintain a predetermined position of said detector means with respect to said second element whereby the position of said first element with respect to said second element is also maintained as the position of said second element varies.

* * * * *

UNITED STATES PATENT AND TRADEMARK OFFICE

CERTIFICATE OF CORRECTION

PATENT NO. : 4,350,275

DATED : September 21, 1982

INVENTOR(S) : William T. Kuhn

It is certified that error appears in the above-identified patent and that said Letters Patent are hereby corrected as shown below:

Column 17, line 30, delete "second".

Column 17, line 33, after "said" insert --second--.

Signed and Sealed this

*Thirteenth* Day of *March 1984*

[SEAL]

*Attest:*

*Attesting Officer*

GERALD J. MOSSINGHOFF

*Commissioner of Patents and Trademarks*